US005094448A

United States Patent [19]

Hackett

[11] Patent Number: 5,094,448

[45] Date of Patent: Mar. 10, 1992

[54] JUMPING APPARATUS

[75] Inventor: Alan J. Hackett, Paris, France

[73] Assignee: Societe Civile Carolan, Paris, France

[21] Appl. No.: 467,687

[22] Filed: Jan. 19, 1990

[30] Foreign Application Priority Data

Jan. 20, 1989 [NZ] New Zealand ..... 227676

[51] Int. Cl.[5] ..... A63B 5/00

[52] U.S. Cl. ..... 272/93; 272/109; 272/135

[58] Field of Search ..... 272/61, 62, 63, 110, 272/111, 112, 113, 109, 101, 135–143, 900, 93

[56] References Cited

U.S. PATENT DOCUMENTS

| | | | |
|---|---|---|---|
| 2,613,932 | 10/1952 | Manners | 272/139 |
| 3,379,439 | 4/1968 | Sorenson et al. | 272/109 X |
| 3,565,424 | 2/1971 | Macabet et al. | 272/139 |
| 3,825,252 | 7/1974 | Geigier | 272/109 X |
| 3,937,461 | 2/1976 | Lew | 272/109 |
| 4,125,257 | 11/1978 | Lew | 272/109 |
| 4,243,219 | 1/1981 | Price | 272/900 X |
| 4,431,184 | 2/1984 | Lew et al. | 272/109 |
| 4,449,716 | 5/1984 | Goldy et al. | 272/109 |
| 4,685,670 | 8/1987 | Zinkin | 272/136 |
| 4,687,194 | 8/1987 | Good et al. | 272/63 |

FOREIGN PATENT DOCUMENTS

| | | | |
|---|---|---|---|
| 1105204 | 7/1984 | U.S.S.R. | 272/109 |

*Primary Examiner*—Robert Bahr

*Attorney, Agent, or Firm*—Dressler, Goldsmith, Shore, Sutker & Milnamow

[57] ABSTRACT

An integrated bungy jumping system for jumping off a platform. Connected to the platform is a rack to which are connected elasticized bungy jumping cords and a control mechanism to adjust the height of the bungy cords to accommodate the weight of the person jumping so that the jumper can control his contact relative to the surface above which he is jumping. The system also includes an arrangement for lowering the jumper to the surface upon completion of the jump. There is also provided a counterweight to return the system to accommodate another jumper.

3 Claims, 3 Drawing Sheets

JUMPING APPARATUS

BACKGROUND TO INVENTION

This invention relates to jumping apparatus. More particularly, but not exclusively, the invention relates to a platform suitable for bungy jumping, a control means for use when bungy jumping and a rack means for securing said control means.

Bungy jumping is a sport where people jump from a structure located above ground level and are secured to the structure by means of an elastic cord. To the present time, apparatus used for bungy jumping has been quite simple. The bungy cord has been attached to a point from which the jumper desires to jump with the other end of the bungy cord being attached to a harness around the feet of a jumper. The jumper then jumps off the side of the bridge or other structure and performs a jump.

This method has major disadvantages. Firstly, each bungy cord must be made to suit the individuals' weight. This is because the extension of the bungy cord is directly proportional to the jumpers' weight. Secondly, once a jump is completed, the jumper is left suspended at some height above the surface over which the jump has been made. This is because the cord is designed to support the jumper just above the surface over which he jumps and when the cord is at the point of maximum extension. After the point of maximum extension has been reached, the jumper is raised by the potential energy stored in the elastic bungy cord and oscillates for some time until the equilibrium point is reached. This equilibrium point is typically some height above the surface over which the jumper has jumped.

Traditionally, a rope has been tied onto the end of the bungy cords and persons at the top of the rope have manually released this to lower the jumper to the surface over which he has been jumping. This involves considerable effort on the part of the persons at the top of the rope as well as being quite dangerous.

A further problem with bungy jumping to the present time has been the structures from which the jumpers jump. Typically the jumpers have merely tied themselves onto the side of the bridge and jumped. This exposes the jumper to the risk of hitting part of the structure of the bridge as he descends.

It is thus an object of the present invention to overcome or at least obviate the disadvantages described above, or at least provide the public with a useful choice.

Further objects of the present invention will become apparent from the following description.

BRIEF SUMMARY OF THE PRESENT INVENTION

According to one aspect of the present invention, there is provided a bungy jumping platform being integral or engageable with a support structure comprising jumper access means and one or more jumping areas communicating therewith said jumping area containing recess means through which the bungy cord/s and portions of the control means may pass thereby minimising interference with the same.

According to a further aspect of the present invention, there is provided a bungy jumping platform being integral or engageable with a support structure comprising one or more jumper preparation areas and one or more jumping areas each associated with a respective preparation area wherein the one or more jumping areas are at a higher or lower level than the one or more jumper preparation areas.

According to a further aspect of the present invention, there is provided a platform as hereinbefore described, wherein the one or more jumping areas extend outwardly beyond the support structure.

According to a preferred embodiment of the present invention, there is provided a platform as hereinbefore described having first and second jumper preparation areas located at the outmost sides of the platform having respective first and second jumping areas in communication with respective preparation areas, but separated from each other.

According to a further aspect of the present invention, there is provided a platform as hereinbefore described wherein the jumping areas are laterally movable with respect to the jumper preparation areas.

According to a further aspect of the present invention, there is provided bungy jumping apparatus comprising one or more elasticised bungy cords located on a support structure and control means attached to the said bungy cord/s at a point of attachment adjustable to raise the point of attachment of the bungy cord to compensate for jumper mass above a predetermined value.

According to a further aspect of the present invention, there is provided control means as hereinbefore described containing a rope means connected to a bungy cord at one end and passing through pulley means fixed above said bungy cord to a second point of attachment below the pulley means, whereby the length of said rope means is adjustable.

According to a further aspect of the present invention there is thus provided rope means connected to a bungy cord at one end and to a counterforce means at the other end thereof, whereby the said rope means may be lowered thereby lowering the bungy cord and jumper to the ground or other surface upon completion of a jump.

According to a further aspect of the present invention there is provided a bungy jumping rack comprising a body portion and securing means whereby the rack is secured to a supporting structure and one or more control means of a bungy jumping apparatus are secureable thereto.

According to a further and final aspect of the present invention, there is provided a bungy jumping system comprising a bungy jumping platform, bungy jumping apparatus (including control means) and a bungy jumping rack.

BRIEF DESCRIPTION OF THE DRAWINGS

Further aspects of this invention, which should be considered in all its novel aspects, will become apparent from the following description given by way of example of possible embodiments thereof and in which reference is made to the accompanying drawings wherein.

DETAILED DESCRIPTION OF THE PREFERRED EMBODIMENTS OF THE PRESENT INVENTION

Figure 1:
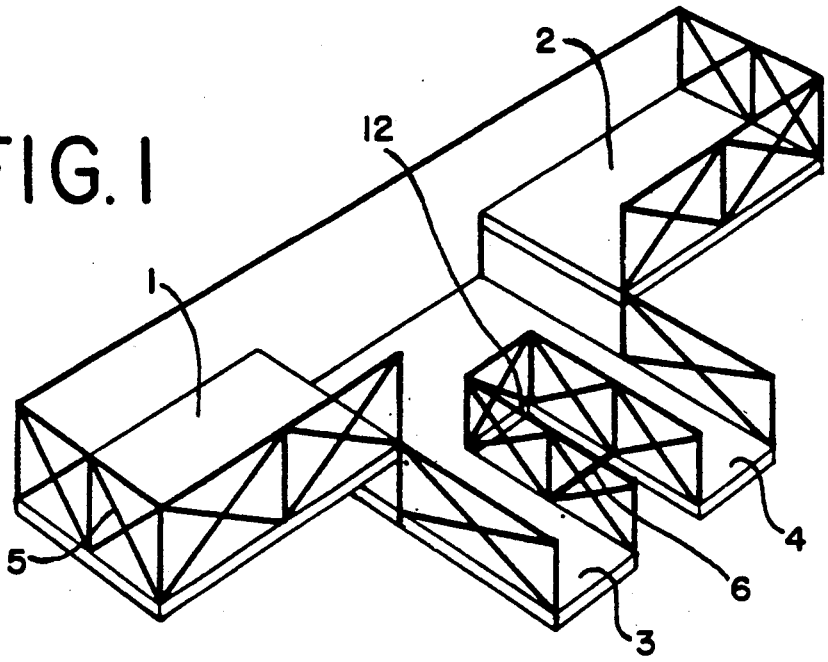
FIG. 1 shows in perspective a jumping platform according to the present invention.
Figure 2:
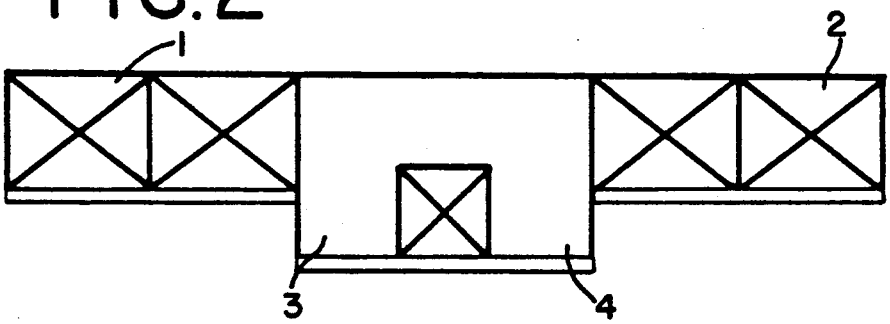
FIG. 2 shows a front view of the platform of FIG. 1.

Referring now to FIG. 1 a platform according to the present invention is shown in perspective. The platform has a first jumper preparation area 1 and second jumper preparation area 2. These preparation areas are seen to have associated jumping areas 3 and 4 respectively connected thereto. Jumping areas 3 and 4 are seen to be at a lower level than preparation areas 1 and 2 and extend outwardly from the preparation areas. It is preferred that the jumping areas be at a higher or lower level than the preparation areas so that ropes may be easily and conveniently handled.

The platform is seen to have railing 5 around the periphery thereof, except for the outermost ends of jumping platforms 3 and 4. These unrailed portions are the locations from which the bungy jumpers will jump from.

Figure 3:
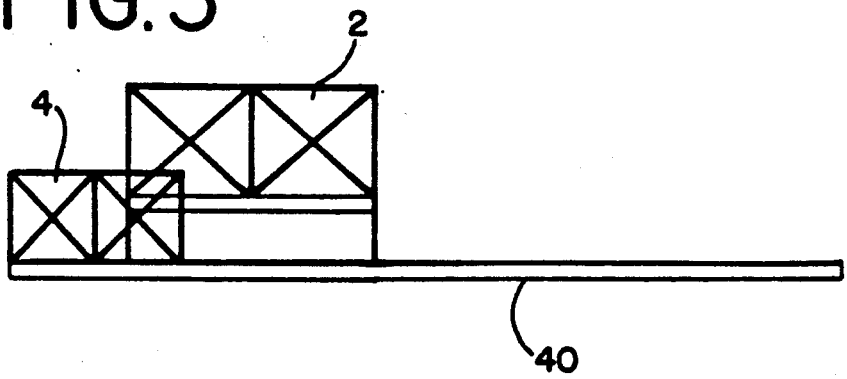
FIG. 3 shows a side elevation of a platform of FIG. 1.

The platform of FIG. 1 is suitable for engagement with a bridge. As best shown in FIG. 3 the platform has a base 40 which may extend under a bridge for attachment thereto. Some permanent fixing means is preferable as the platform must support quite large forces. Thus the platform extends well beyond the edge of the structure and there is no risk of the jumper hitting any part of the structure during the jump.

It is envisaged that in use persons within a first weight range will assemble in preparation area 1 and persons within a second weight range will assemble in preparation area 2. In the preparation areas, the jumpers will be instructed and prepared for their jump. The individual will then be weighed and proceed to jumping area 3 or 4 respectively. The weight measured will be used to determine the appropriate weight compensation (discussed later) for that particular jumper and adjustments will be made accordingly. The jumper will then be attached to the bungy cord and jump from jumping area 3. It is envisaged that by having two jumping areas in use simultaneously that a jumper may jump from one platform whilst the jumper on the other side is preparing for their jump.

In a preferred form of the present invention, the jumping platforms 3 and 4 will be laterally movable with respect to the preparation areas so that they may be oriented to ensure that a jumper clears any obstructing objects below.

Figure 4:
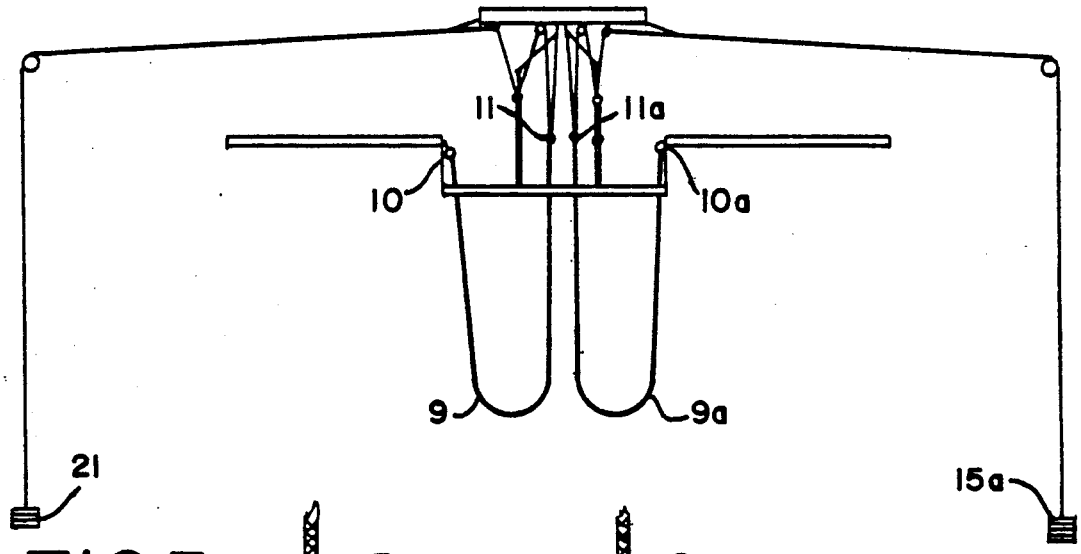
FIG. 4 shows the overall layout of the rack, bungy cords and control means in relation to the platforms.
Figure 5:
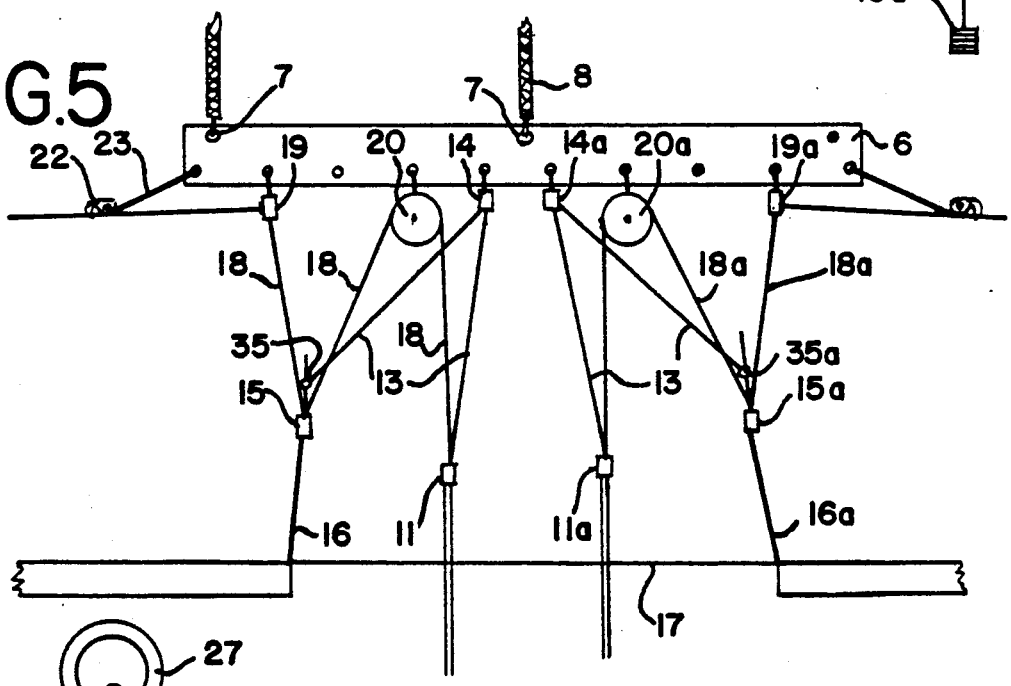
FIG. 5 shows an enlarged view of the rigging section shown in FIG. 4.

Referring now to FIGS. 4 and 5, the bungy jumping rack, bungy cord, and control means are shown in detail. Rack 6 may be secured to the structure to which the platform is attached by means of a plurality of shackles 7 and straps 8. Previously the individual fittings have had to be separately secured to the jumping area or platform, which is a time consuming procedure. The rack of the present invention allows everything to be attached to the rack 6 and the rack attached to the structure. In this way once rack 6 is secured jumping may commence and the long set-up time previously required is avoided.

It is to be appreciated any securing means may be utilised and it is the attachment of the fittings and ropes to an easily demountable rack that provides one of the advantages of the present invention. In the FIG. 5 embodiment the pulleys 19 and 20 in particular are suspended below rack 6. However, an integral rack system is envisaged whereby the said pulleys are mounted onto a backing plate and preferably encased in a cover to prevent or minimise the risk of injury to jumpers. The said rack system may comprise a rigid backbone and backing sheet the said pulleys and other components such as brakes being attachable to the latter; while the cover may be constructed of a lightweight material such as fiberglass or plastic.

Bungy cords 9 and 9*a* are seen to be attached at points of attachment 11 and 11*a* and have free ends 10 and 10*a* to which a jumper attaches themselves. Rack 6 is positioned somewhere in the region indicated by numeral 6 in FIG. 1 with the free ends 10 and 10*a* of the bungy cords, being positioned at the ends of jumping areas 3 and 4.

Referring to FIG. 5 there are shown ropes 13 and 13*a* connected to points of attachment 11 and 11*a* which pass through pulleys 14 and 14*a* connected to rack 6. The other end of shock cords 13 and 13*a* being connected to karabiners 35 and 35*a*. Karabiners 35 and 35*a* are seen to have ropes 16 and 16*a* securing them to the jumping platform 17.

In use, the length of ropes 18 and 18*a* may be adjusted depending on the weight of the person jumping. When a person of weight above that designed for the particular bungy cord jumps, the bungy cord extends to a greater extent. To compensate for this (so the person does not hit the surface above which the jump is being made), points of attachments 11 and 11*a* may be raised accordingly.

This may be achieved by shortening the length of ropes 18 and 18*a* by tying them to karabiners 35 and 35*a* at a point further along ropes 18 and 18*a*. Other means of shortening the length of rope 18 may of course be used.

Thus, after a jumper has been weighed, the length of rope 18 will be adjusted to compensate for that person's weight so that when the person jumps, the point of maximum extension of the bungy cord will be above the surface over which the jumper is jumping, or in the case of water penetration is restricted.

Once a jump has been completed, the jumper is at a point of equilibrium some distance above the surface over which they have jumped. To lower the person to the level of the surface over which they have jumped, the lowering apparatus of the control means of the present invention is utilised.

Firstly, for the left hand side, rope 13 is untied from karabiner 35 so that the weight of the bungy cord and jumper are taken by rope 18. Whilst this cord is being released other persons hold on to rope 18 to take the weight of jumper and cord. These persons may then slowly allow rope 18 to release, thus lowering the bungy cord and jumper. It is to be appreciated that due to the sharp angles which rope 18 passes through pulleys 15, 19 and 20 that quite a lot of friction is introduced and the weight of bungy cord and jumper is easily managed by two people.

Where the word "pulley" is used in this specification it is to be understood to include any fitting such as a karabiner etc. In a preferred form of the present invention a centrifugal or hinged brake may be used in conjunction with rope 18 so that even if it were released the centrifugal brake would prevent further releasing of the line.

As rope 18 is relaxed, lowering the jumper and cord, counterweight 21 is raised. Once the jumper has been lowered to the surface they can be disengaged from the bungy cord. With no weight counterbalancing counterweight 21 it acts to force point of attachment 11 to rise. However brake 22 prevents the release of rope 18 until it has been released. Upon release point of attachment 11 may be raised just below the desired level by counterweight 21 ready for another jump. The point of attachment 11 will preferably not be raised completely to the level required for a jump. Upon affixment of rope 13 to the desired level point of attachment 11 will be raised slightly. In this way no shock is taken by line 18, although in the unlikely event line 13 brakes line 18 would then carry the load and if a centrifugal brake were employed this would arrest the fall.

The bungy cords 9 and **9*a* may be formed of relatively elastic materials. Ropes 13, 13*a*, 18, 18*a*, 16 and 16*a*** may preferably be formed of somewhat inelastic materials.

Figure 6:
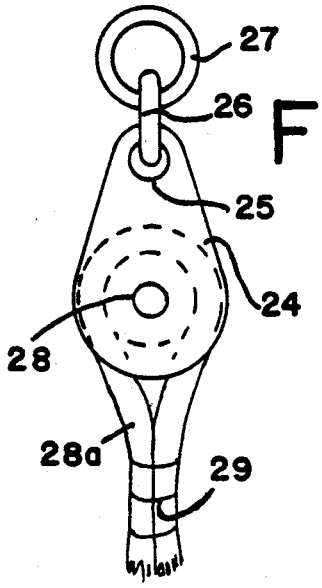
FIG. 6 shows the connection of a bungy cord to a fitting.

Referring now to FIG. 6, the point of attachment 11 is shown in greater detail. There is seen to be a first fitting 24 having an aperture 25 therein through which a sling 26 connects fitting 24 to a karabiner 27. At the other end of the fitting there is seen to be a central portion 28 around which the elements of the bungy cord **28*a* are threaded with a plurality of binding cords 29** wrapped around the bungy cords.

There have been problems with the points of attachment points up to the present time. Typically the bungy cord elements are forced to sharply change direction around a small central portion 28. This has led to rapid deterioration of bungy cords.

In the fitting of the present invention the central portion is larger than normally used to decrease the stress on cord elements in this area. It has been found that central portion diameters of 10 to 50 mm are successful. In addition it has been found that the central portion may be constructed of or coated with a suitable anti-friction material such as teflon.

Figure 7:
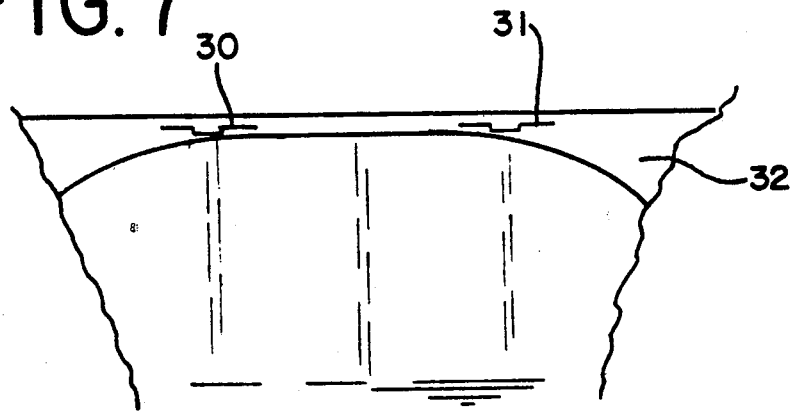
FIG. 7 shows the positioning of jumping platforms with respect to a bridge from a side elevation.
Figure 8:
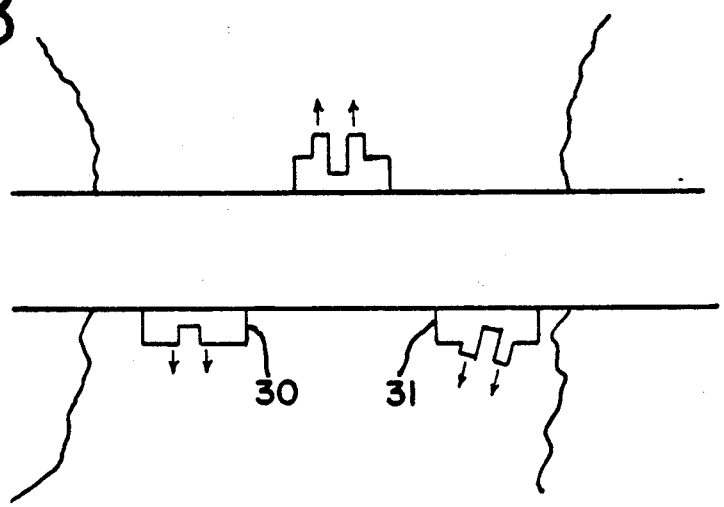
FIG. 8 shows a plan view of jumping platforms shown in FIG. 7.

Referring now to FIG. 7, jumping platforms 30 and 31 are shown located on a bridge 32. These jumping platforms are positioned so that the jumper will be free from obstacles such as cliffs as they descend.

Figure 9:
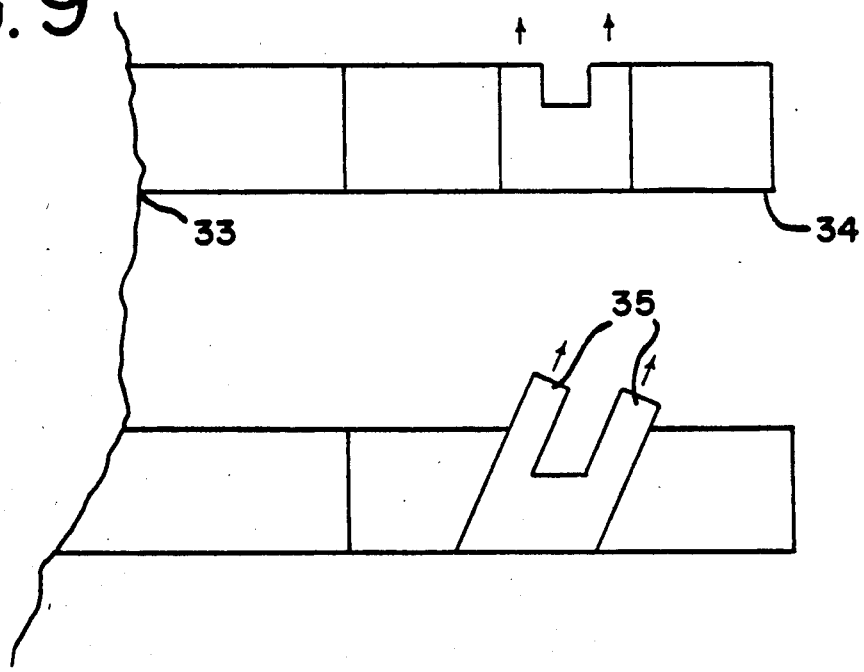
FIG. 9 shows platforms attached to a cliff edge.

FIG. 9 shows a further embodiment wherein the jumping platform is connected directly to the side of a cliff (the word "structure" when used in this specification includes a land structure). The edge of the platform 33 is connected directly to the cliff edge by some suitable means. Lines extend from end 34 up to a point higher on the cliff to provide further support. In this embodiment rack 6 is connected directly to the platform and carries the weight of the bungy jumper. In the lower embodiment of FIG. 9, the jumping platforms 35 are seen to be at an angle relative to the platform so that jumpers follow the contour of the cliff.

It is thus seen that the present invention provides a platform and control means (containing weight compensating means and lowering means) which increase the safety and ease of bungy jumping.

I claim:

1. A bungy jumping apparatus adapted to be connected to multiple platform jumping areas on a high supporting structure like a bridge or cliff comprising:

a rack system adapted to be connected to the platform jumping areas;

a first pair of pulleys connected to said rack system;

first inelastic cord means having one end adapted to be connected to the platform jumping areas and its other end extending over each of said pulleys;

elastic bungy cord means connected to the other end of each of said inelastic cords and having a free end adapted to be attached to the feet of a jumper;

a second pair of pulleys affixed to said rack system and located inwardly of said first set of pulleys;

second inelastic cord means secured at one end to each of said bungy cords and at its other end to said first inelastic cords at a point outwardly of said first pair of pulleys for adjusting the extension of said bungy cords to compensate for the weight of the jumper; and a third pulley system outwardly of each of said first pair of pulleys, said first inelastic cords being each disposed thereover and operable to lower the jumper to a landing surface after the jump and the cessation of oscillation of the bungy cord.

2. A bungy jumping apparatus as set forth in claim 1 comprising plus a brake for preventing release of said first inelastic cord means until the brake has been released.

3. A bungy jumping apparatus as set forth in claim 2 comprising a counterweight secured to said first inelastic cord means for returning the apparatus to accommodate a subsequent jumper.

* * * * *